US006635492B2

(12) United States Patent
Gunter

(10) Patent No.: US 6,635,492 B2
(45) Date of Patent: Oct. 21, 2003

(54) HEATING SPECIMEN CARRIERS

(75) Inventor: Ian Alan Gunter, Stanmore (GB)

(73) Assignee: BJS Company Ltd., Greenford (GB)

( * ) Notice: Subject to any disclaimer, the term of this patent is extended or adjusted under 35 U.S.C. 154(b) by 189 days.

(21) Appl. No.: 09/815,696

(22) Filed: Mar. 23, 2001

(65) Prior Publication Data

US 2001/0019704 A1 Sep. 6, 2001

Related U.S. Application Data

(63) Continuation-in-part of application No. 09/117,202, filed as application No. PCT/GB97/00195 on Jan. 1, 1997, now abandoned.

(30) Foreign Application Priority Data

Jan. 25, 1996 (GB) ..... 9601471
Feb. 22, 1996 (GB) ..... 9603717
Mar. 24, 2000 (GB) ..... 0007219

(51) Int. Cl.[7] ..... H05B 3/10

(52) U.S. Cl. ..... 436/174; 219/435; 219/670; 219/672; 219/674; 366/146; 366/273; 422/99; 422/102; 435/287.2; 435/288.4; 435/809

(58) Field of Search ..... 422/99, 102; 435/809, 435/287.2, 288.4; 219/435, 670, 672, 674; 366/146, 273; 436/174

(56) References Cited

U.S. PATENT DOCUMENTS 3,751,965 A * 8/1973 Kraus ..... 73/19.12
3,835,529 A * 9/1974 Taguchi ..... 29/25.01
4,305,559 A 12/1981 Jackson
4,728,500 A 3/1988 Higo
5,160,586 A * 11/1992 Yoshimoto et al. ..... 588/261
5,410,130 A 4/1995 Braunstein
5,415,839 A * 5/1995 Zaun et al. ..... 422/64
5,423,974 A * 6/1995 St-Amant et al. ..... 205/50
5,504,007 A * 4/1996 Haynes ..... 435/285.1
5,525,300 A 6/1996 Danssaert et al.
5,529,391 A 6/1996 Kindman et al.
5,616,301 A 4/1997 Moser et al.
5,690,851 A 11/1997 Yoshioka et al.
RE35,716 E 1/1998 Stapleton et al.
5,960,976 A 10/1999 Tsuno

FOREIGN PATENT DOCUMENTS

EP 0058428 A2 8/1982
EP 0603411 A1 6/1994
GB 316969 A 10/1930
GB 1134957 A 11/1968
JP 5-168459 A * 7/1993
WO WO 95/01559 1/1995
WO WO 97/26993 A 7/1997

OTHER PUBLICATIONS

Advertisement: "DNA Amplification System," Perkin Elmer Cetus.
Advertisement: "GeneAmp PCR System 9600," Perkin Elmer Cetus.

* cited by examiner

*Primary Examiner*—Jan Ludlow
(74) *Attorney, Agent, or Firm*—Clifford W. Browning; Woodard, Emhardt, Moriarty, McNett & Henry LLP

(57) ABSTRACT

A method and apparatus for heating specimens in wells of a metallic specimen carrier. The specimen carrier is heated by applying resistive heating directly to the carrier. An AC source and transformer may be used where the specimen carrier is in series with a single turn secondary winding of the transformer. A magnet may be placed in each well and excited by the heating current to provided a stirring effect.

38 Claims, 4 Drawing Sheets

HEATING SPECIMEN CARRIERS

This application is a continuation-in-part of U.S. application Ser. No. 09/117,202, filed Jul. 24, 1998, now abandoned which is a 371 of PCT/GB97/00195 filed Jan. 1, 1997.

The present invention relates to heating and more particularly to the thermal cycling of specimen carriers.

In many fields specimen carriers in the form of support sheets which may have a multiplicity of wells or impressed sample sites, are used for various processes where small samples are heated or thermally cycled.

A particular example is the Polymerase Chain Reaction method (often referred to as PCR) for replicating DNA samples. Such samples require rapid and accurate thermal cycling, and are typically placed in a multi-well block and cycled between several selected temperatures in a pre-set repeated cycle. It is important that the temperature of the whole of the sheet or more particularly the temperature in each well be as uniform as possible.

The individual samples are normally liquid solutions, typically between 1 $\mu$l and 200 $\mu$l in volume, contained within individual sample tubes or arrays of sample tubes that may be part of a monolithic plate. It is desirable to minimize temperature differentials within the volume of an individual sample, during thermal processing. The temperature differentials that may be measured within a liquid sample increase with increasing rate of change of temperature and may limit the maximum rate of change of temperature that may be practically employed.

Previous methods of heating such specimen carriers have involved the use of attached heating devices such as wire, strip and film elements and Peltier effect thermoelectric devices, or the use of indirect methods where separately heated fluids are directed into or around the carrier The previous methods of heating suffer from the disadvantage that heat is generated in a heater that is separate from the specimen carrier that is required to be heated.

The thermal energy must then be transferred from the heater to the carrier sheet, which in the case of an attached heater element occurs, through an insulating barrier and in the case of a fluid transfer mechanism occurs by physically moving fluid from the heater to the sheet.

The separation of the heater from the block introduces a time delay or "lag" in the temperature control loop. That is to say that the application of power to the heating elements does not produce an instantaneous or near instantaneous increase in the temperature of the block. The presence of a thermal gap or barrier between the heater and the block requires the heater to be hotter than the block if heat energy is to be transferred from the heater to the block. Therefore, there is a further difficulty that cessation of power application to the heater does not instantaneously stop the block from increasing in temperature.

The lag in the temperature control loop will increase as the rate of temperature change of the block is increased. This can lead to inaccuracies in temperature control and limit the practical rates of change of temperature that may be used.

Inaccuracies in terms of thermal uniformity and further lag may be produced when attached heating elements are used, as the elements are attached at particular locations on the block and the heat produced by the elements must be conducted from those particular locations to the bulk of the block. For heat transfer to occur from one pan of the block to another, the first part of the block must be hotter than the other.

Another problem with attaching a thermal element, particularly a Peltier effect device, is that the interface between the block and the thermal device will be subject to mechanical stresses due to differences in the thermal expansion coefficients of the materials involved. Thermal cycling will lead to cyclic stresses that will tend to compromise the reliability of the thermal element and the integrity of the thermal interface.

The present invention aims to solve at least some of these problems by applying direct electrical resistance heating to a metallic specimen carrier. Thus the invention provides a method of heating a specimen carrier in the form of a metallic sheet by applying a heating current to said sheet.

The electric current passing through it directly heats the sheet; this removes lags in the temperature control loop. The whole of the sheet can be substantially instantaneously heated.

Preferably the metallic sheet will be of a metal having high thermal conductivity such as copper or silver. Small variations in metal thickness or thermal loading over the area of the sheet may be tolerated if the thermal conductivity of the sheet is high enough to equalise the temperature differences between any localised high or low temperature regions. The level of temperature variation that may be tolerated will depend upon the application, for PCR, applications more than 0.5 C is not tolerable.

Silver is preferred over copper in some circumstances, for example when rapid thermal cycling is to be used, as silver has a lower specific heat capacity than copper and will therefore require less energy to produce any particular temperature change.

The sheet will generally have a thin section in the region of 0.3 mm thickness, say in the range of 0.2–0.5 mm.

The sheet may be in a form where a matrix of sample wells is incorporated in the sheet.

The sheet may have an impressed regular array of wells to form a block and a basal grid or perforated sheet may be attached to link the tips of the wells at their closed ends to form an extremely rigid three-dimensional structure. In some applications the mechanical stiffness of the block is an important requirement. Where a basal grid is used, heating current is also passed through the metal of the grid. The basal grid is preferably made of the same metal as the block.

While the metallic sheet may be a solid sheet of silver (which may have cavities forming wells) an alternative is to use a metallised plastic tray (which may have impressed wells), in which deposited metal forms a resistive heating element.

Another alternative is to electro form a thin metal tray (which again may have impressed wells), and to coat the metal with a bio-compatible polymer.

These measures enable intimate contact to be achieved between the metallic heating element and the bio-compatible sample receptacles. This gives greatly improved thermal performance in terms of temperature control and rate of change of temperature when the actual temperatures of the reagents in the wells is measured.

The plastic trays are conventionally single use disposable items. The incorporation of the heating element into the plastic trays may increase their cost, but the reduction in cycling time for the PCR reaction more than compensates for any increased cost of the disposable item.

The bottom of the composite tray should be unobstructed if fan cooling is employed. If sub-ambient cooling is required at the end of the PCR cycles, either with a composite tray or a block, chilled liquid spray-cooling may be employed. The boiling point of the liquid should be below the low point of the PCR cycle so that liquid does not remain on the metal of the tray or block to impede heating. This also allows for the latent heat of evaporation of the liquid to increase the cooling effect.

The heating current may be an alternating current supplied by a transformer system wherein the heating power is controlled by regulating the power supplied to the primary winding of the transformer. The sheet to be heated may be made part of the transformer secondary circuit. The secondary winding may be a single or multiple loop of metal that is connected in series with the sheet. By these means, the high current, low voltage power that is required to heat the highly conductive sheet may be simply controlled by regulating the high voltage, low current power supplied to the primary winding of the transformer.

The transformer may comprise a toroidal core having an appropriate mains primary winding and a single bus bar looped through the core and connected in series with the metallic sheet to form a single turn secondary circuit.

When heating samples in sample wells of a carrier in the way described above it is sometimes desirable to provide agitation or stirring.

In a development of the invention the heating current is an alternating current, and a magnet is loosely contained within at least one well and is arranged to be agitated by the alternating current so as to provide a stirring action during the heating.

According to another aspect of the invention there is provided a method of heating a specimen carrier in the form of a metallic sheet and in which a matrix of sample wells is incorporated in the sheet, which method includes applying an alternating current to said sheet to provide heating of the samples in the wells, and a magnet is loosely contained within at cast one well and is arranged to be, agitated by the alternating current so as to provide a stirring action during the heating.

Usually, but not necessarily always, each well will contain a magnet.

The sample wells may incorporate samples directly or may carry sample pots or test tubes shaped to closely fit within the wells.

Generally the sample wells may be conical in shape. This helps any stirring action of each magnet within the respective well.

More specifically, in direct resistance heating using alternating current, an oscillating magnetic field is produced at each well by the heating current. A small bar magnet, (typically 5 mm long by 1 mm diameter), may be placed in each sample tube and the heating current will cause oscillating forces to be applied to the magnet. The geometry of the conical section of the sample tube will then constrain the bar to spin about an axis that is not coaxial with, or normal to, the axial dimension of the bar. The stirring action is then similar to that which would be produced by vigorously stirring each individual tube with a manual stirring rod.

The magnets may be made of readily available materials, in particular hard magnetic alloys such as Alnico 4. Rare earth magnets (for example iron-neodymium-boron or samarium-cobalt) may also be used. To prevent contamination of the liquid sample, the magnet may be given an inert coating. Such a coating may be of a bio-compatible polymer such as polypropylene or polycarbonate, or a noble metal such as gold. A noble metal coating has the advantage that it adds no significant volume to the magnet when applied in a coating of sufficient thickness to ensure that the coating is not porous. When using gold a 5 $\mu$m thickness is sufficient to provide a porefree coating, and adds a volume of 0.08 $\mu$l to the magnet.

The magnets cost much less than the typical reagent mix to be placed in a sample tube, and may therefore be regarded as consumable items. However the magnets may clearly be easily sorted from the waste reagents for cleaning and re-use.

The magnets may be small. In particular embodiments, for a 100 $\mu$l liquid sample, a magnet 1 mm in diameter and 5 mm long may be employed. Such a magnet has a volume of 3.9 $\mu$l. A 0.5 mm diameter by 3 mm long magnet may be provided for use in smaller tubes and would have a volume of 0.58 $\mu$l. The approximate masses of these magnet examples would be 31 mg and 4.5 mg respectively.

In certain embodiments, a magnet is placed in each of the wells to be agitated. In standard practice the shape of the individual wells is conical and the magnet length is chosen such that the long axis of the bar magnet is constrained to be within a range of between 5 and 30 degrees of the axis of the well. Such orientation ensures that the agitation magnet will spin eccentrically and will not jam in the well. The diameter of the magnet should be as small as is practical, in order to minimise the volume of the magnet. The passage of the alternating heating current through the block gives rise to an alternating magnetic field circling the block in a plane normal to the direction of current flow. The alternating magnetic field causes alternating forces to be applied to the bar magnets as they try to align themselves with the magnetic field. The conical shape of the wells constrains the movement of the magnets, which then spin eccentrically in each well.

The effect of the eccentric spinning of the magnets is to vigorously stir the liquid sample in each of the wells to which a magnet has been introduced. The stirring effect almost completely eliminates any of the temperature differentials that may be observed in a static sample during thermal cycling.

Preferably, the bottom of the sheet, even if a basal grid is attached, has an open structure with a large surface area. Such a surface is ideal for forced-air cooling. Moreover, preferably there are no attached elements to impede free and full contact between the metal of the sheet and moving air.

Ducting of the air may be provided to encourage even cooling effects over the extent of the sheet. To allow for controlled cooling rates, the air movement may be under proportional control. The control response time of a device that imparts movement to air, for instance a mechanical element such as a fan, is slow compared to the fast electronic control response of the heating system. The heating system may therefore be used together with the fan to control the temperature changes of the sheet during cooling The secondary winding in series with the sheet may have more than one loop through the core of the transformer.

The power supply means and control for the heating current may be a high frequency AC power supply permitting a reduction in the amount of material in the transformer core.

The thermal uniformity of the sheet will be dependent on the heating power dissipation at any point in the sheet being matched to the thermal characteristics of that point. For instance, a point around the centre of the sheet will be surrounded by temperature controlled metal, whereas a point at the edge of the sheet or block will have temperature controlled metal on one side and ambient air on the other. The geometry of the sheet may be adjusted with the aim of achieving thermal uniformity. In general practice the geometry of sample sites or wells of a sheet or block will be a standardised regular array. The industry standard arrays consist of 48, 96 or 384 wells in a 110×75 mm rectangular plate or block. These layouts are arbitrary and larger arrays of 768 and 1536 wells are appearing.

Typically, the geometric factors that may be varied comprise the thickness of the metal from which the sheet is formed, and if a basal grid is used, the geometry of the webs in the plane of the grid.

Embodiments of the invention will now be described by way of example with reference to the accompanying diagrammatic drawings in which.

Figure 1:
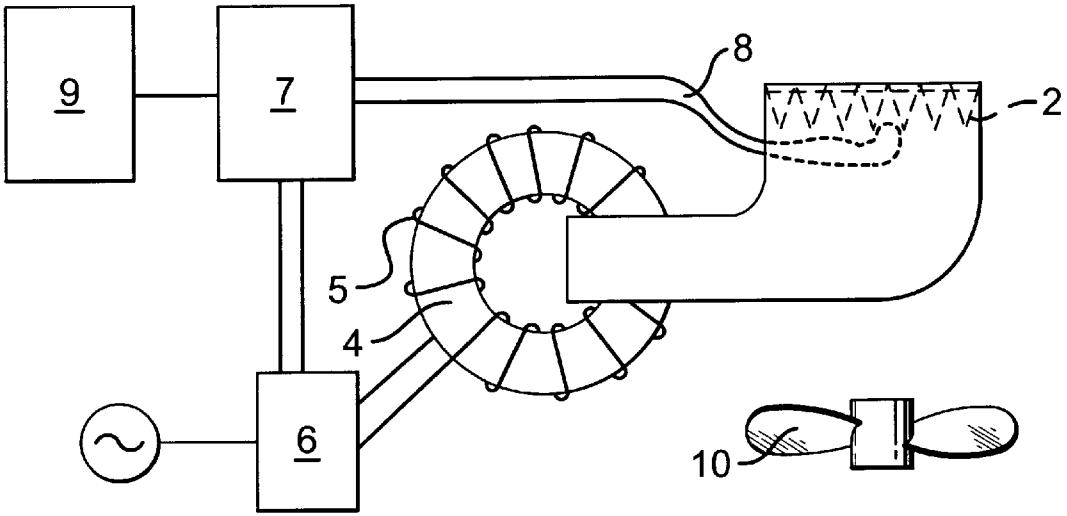
FIG. 1 is a side elevation of a heating apparatus.

A metallic sheet specimen carrier in the form of a multi-well block (1) measuring 110 mm×75 mm and having 96 wells (2) disposed in a grid layout is formed in silver nominally 0.3 mm thick. This is attached to bus bars (3) of substantial cross-sectional area. The bus bars loop once through a transformer (toroidal or square), core (4). The core (4) has a primary winding (5) appropriate for the mains voltage employed. The bus bars (3) also act as a structural member supporting the block (1). The transformer primary current is controlled using a triac device (6). The triac device receives current from an AC source and is controlled by a temperature control circuit (7) which uses at least one fine wire thermocouple (8) soldered to a central underside region of the block to sense the temperature of the block. The temperature control circuitry may be operated manually or by a personal computer (9). More specifically, the heating power may be controlled by proportional phase angle triggering of the triac (6) in response to signals from the thermocouples (8) combined with programmed temperature/time information entered to describe the required thermal behaviour of the apparatus.

Cooling of the block is by means of a fan (10) mounted under the block, passing ambient air over the protruding well forms (2), the air being directed by the enclosure in which the block is mounted. The fan is controlled by the same temperature control circuitry that drives the heater triac. Although not shown in detail, the airflow is guided to give even cooling of the block (1) by means of multiple shaped air inlets on the top, sides and bottom of the apparatus enclosure. The fan extracts air from the inside of the enclosure. The negative pressure within the case is varied proportionally by proportionally controlling the fan speed.

It will be appreciated that the rear surface of the block (1) has a large surface area which is ideally suited to the dissipation of heat.

The measured performance of the example apparatus gives rates of change of temperature in excess of 6 degrees per second and over/under shoots of less than 0.25 degrees within the typical PCR working range of 50–100 degrees. The thermal uniformity of the block is such that within 10 seconds of any temperature transition, even at rates of change of temperature in excess of 6 degrees Celsius per second, the range of temperatures that may be measured in wells around the block does not vary more than ±0.5 degrees from the mean temperature.

The block (1) of the present embodiment will have an electrical resistance of around 0.00015 Ohms. To obtain the levels of heating desired, a current in the order of 1600A is supplied to the block. The order of this required current is easily calculable on the basis of the size of the block and the innate properties of silver. The current in the primary winding (5) might be up to around 3A at 240V or 7A at 110V. Thus even though high current is supplied across the block (1), the voltage across the block remains low, say 0.25V. Further, the block (1) and bus bars (3) are isolated from mains power and may be connected to ground to enhance safety further.

The described example uses a silver block with cavities, but metallised plastic tray inserts, or electro formed thin metal trays, as previously described, may also be used.

The system as described has several important advantages.

1.1 The block is heated directly with no requirement for heat transfer from an attached heat source. This is very efficient and taken together with the very low specific heat capacity of silver allows very rapid temperature changes.

1.2 Direct heating means that there is no thermal lag at all. Temperature control functions are immediate so that the block may be cycled in temperature with little or no over or undershoot. Temperature control is therefore inherently precise.

1.3 Since there are no obstructions or thermal barriers attached to the block, simple forced-air cooling of the back of the block provides rapid and controllable cooling.

1.4 The fine wire thermocouple is soldered directly to the block so as to provide close temperature measurement and control. Any other temperature measurement device may be used as long as it does not introduce significant sensor lag.

1.5 The temperature distribution around the surface of the block is dependent on the evenness of heating and the thermal conductivity of the block. The thermal conductivity of silver is very high, and the distribution of heat energy around the block is dependent upon the distribution of the heating current. This may be regulated by varying the geometry of the multi-well block. The variation in geometry will typically be achieved by spatial variation in the thickness of the block (1) such that, (for instance), the minimum metal thickness (of about 0.25 mm), may be found at the middle of the block surface and the maximum metal thickness (of about 0.4 mm), may be found along the edges of the block (1) parallel to the longer axis. The variations in metal thickness are used to maintain thermal uniformity across the area of the block during thermal cycling by compensating for the differing thermal environments experienced by different points in the block (1).

The variations in metal thickness are produced whilst manufacturing the block by electroforming. During the electroforming process the distribution of the electrodepositing, current is modulated such that the depositing current is higher in areas where a greater thickness of metal is required.

The overall geometry of the block is standardised to accept liquid samples of 20–100 $\mu$l contained in either individual 200 $\mu$l sample tubes or arrays of samples contained in a 96 well microplate.

The large currents required may be easily produced and controlled since the block becomes part of a heavy secondary circuit of the transformer. The cross-sectional area of the winding bars is made considerably larger than the cross-sectional area of the block so that significant heat generation only occurs in the block. The current can be easily controlled in the primary winding (where the current is small), using thyristors, triacs or other devices. Alternatively, the primary winding may be driven by a high frequency, switch mode, controllable power supply. This allows the same degree of control of the current induced in the secondary winding incorporating the block, but the high frequency allows the use of a more compact core in the transformer.

Figure 3:
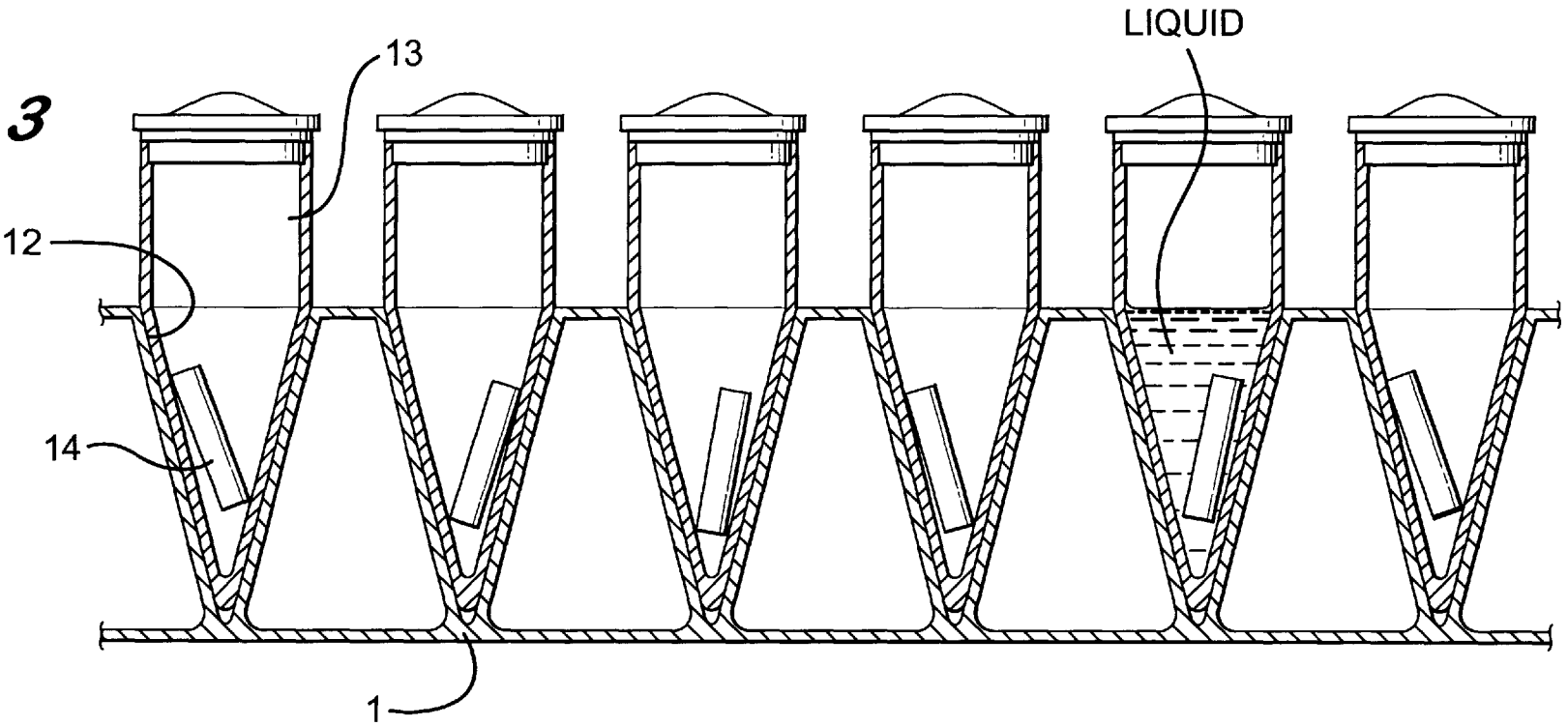
FIG. 3 is a side view of sample tubes incorporating magnets and located in wells of a sheet of the heating apparatus of FIG. 1.
Figure 4:
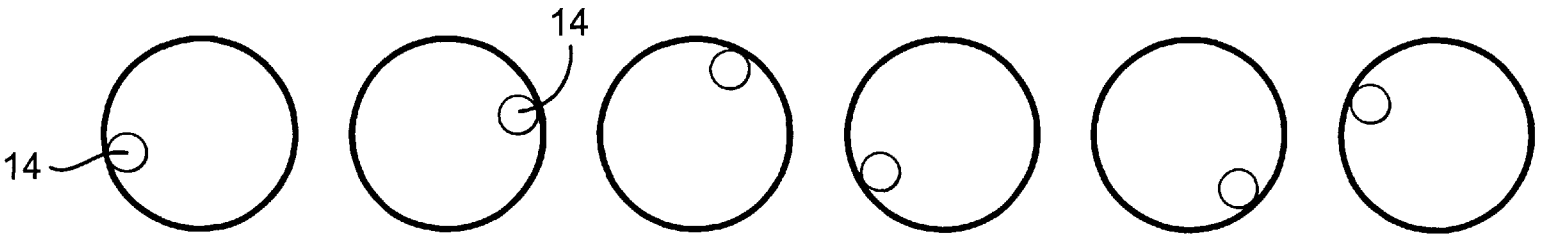
FIG. 4 is a top plan view showing the magnet location.

Referring now to FIGS. 3 and 4, a novel stirring arrangement is shown. A sample carrier (1)(which is equivalent to the block (1) described above) has conical cavities (12) carrying 200 μl sample tubes (13). Then, within each tube is loosely carried a magnet (14).

Each is a small bar magnet, (typically 5 mm long by 1 mm diameter), which is placed in each sample tube and the heating current is then able to cause oscillating forces to be applied to the magnet. The geometry of the conical section of the sample tube will then constrain the bar to spin about an axis that is not coaxial with, or normal to, the axial dimension of the bar. The stirring action is then similar to that which would be produced by vigorously stirring each individual tube with a manual stirring rod.

The magnets can be made of readily available materials such as Alnico 4 and coated with non-reactive materials such as polypropylene of PTFE or nobel metals such as gold, for example a 5 μm layer of acid hard gold plating may be used. The magnets cost much less than the typical reagent mix to be placed in a sample tube, and may therefore be regarded as consumable items. However the magnets may clearly be easily sorted from the waste reagents for cleaning and re-use.

The magnets are small, 1 mm diameter by 5 mm long which gives a volume of 3.92 μl for use in a 200 μl sample tube. A 0.5 mm diameter by 3 mm long magnet for use in smaller tubes has a volume of 0.58 μl. The approximate masses of these magnets are 31 mg and 4.5 mg respectively.

The action of the agitation magnets not only removes measurable temperature differentials from the 100 μl liquid samples used, but also increases the overall rate of heat transfer from the block to the sample. Thus the programmed temperature/time profile is more accurately reproduced in the thermal processing experienced by the liquid sample.

Figure 2:
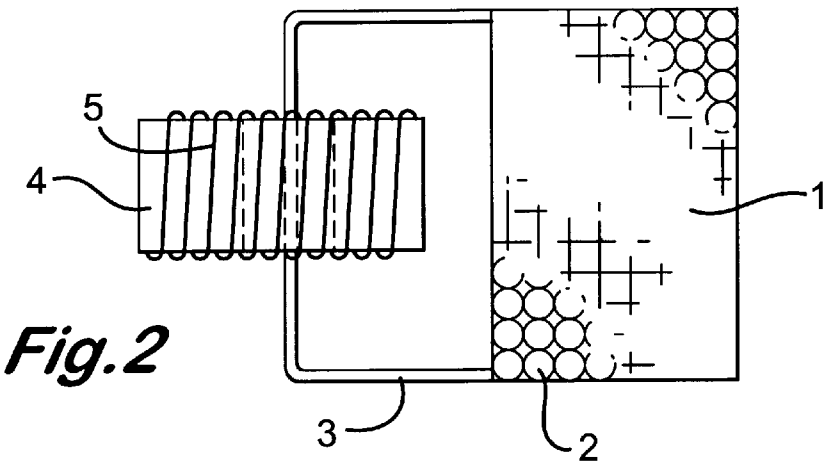
FIG. 2 is a plan view of the apparatus of Figure.
Figure 5A:
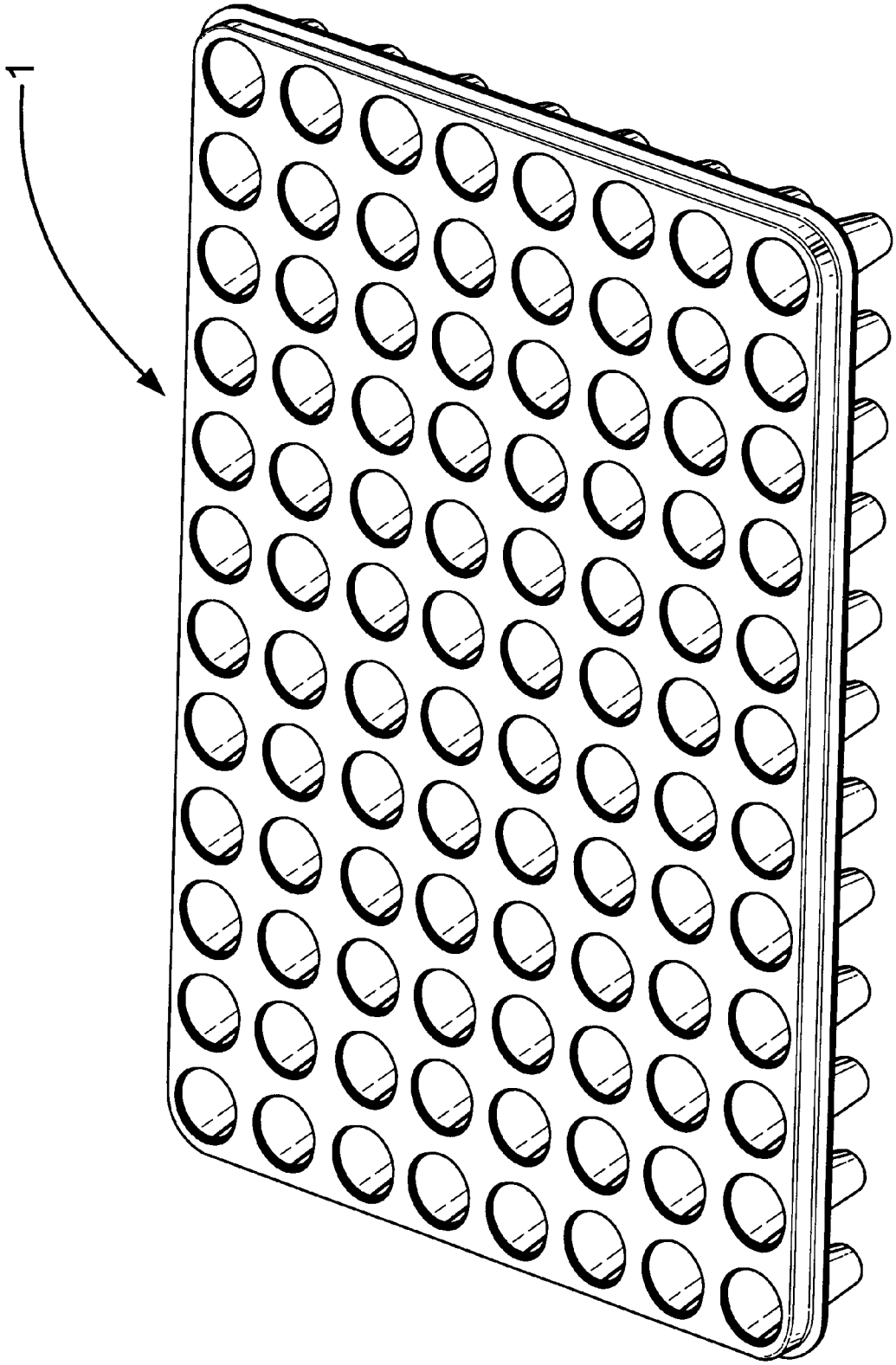
FIGS. 5A to 5C shows a perspective, plan and side view of the block specimen carrier of the apparatus shown in FIG. 1.
Figure 5B:
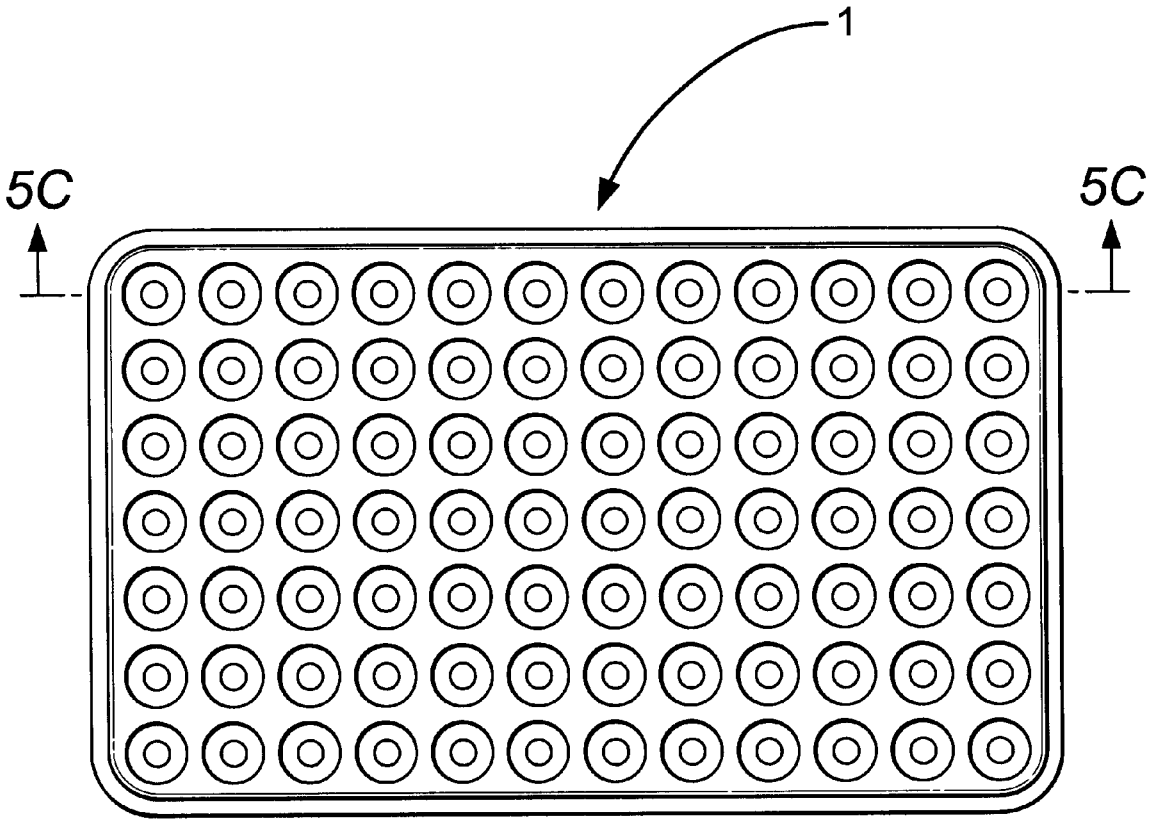
Figure 5C:
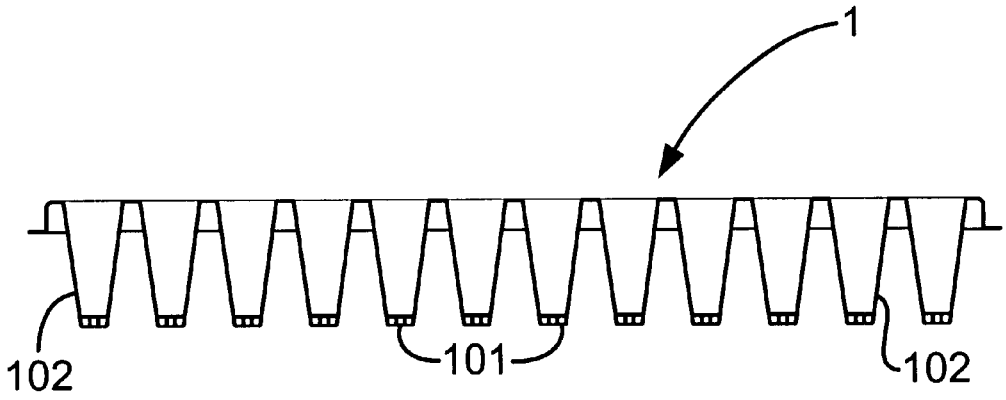

FIGS. 5A to 5C show the sample carrier sheet (block) (1) of FIGS. 1, 2 and 4 in more detail. As described above this metallic specimen carrier is in the form of a multi-well block (1). This block (1) measures 110 mm×75 mm and has an 8×12 array of standardised conical wells 12 mm deep and is formed in silver having an average metal thickness of 0.33 mm. An attached basal grid may also be provided which ties together to exterior bottoms (101) of the wells.

It will be seen that the wells in the sheet (1) have a significant depth and thus include side walls (102) and have an overall generally frustoconical shape. The wells are arranged to accept and surround a significant portion of any sample tubes positioned in the wells. This can help in the efficient transfer of heat into and/or out of samples. A large surface area of tube is in contact with the sheet (1). Furthermore, in cooling it will be noted that this large area of tube is in direct contact with a portion of the sheet, ie the exterior or underside of the wells, over which ambient air is fed.

Similar considerations also apply if samples are placed directly in the sheet rather than in a sample tube.

It has been found that mains frequency currents eg 50 Hz provide a good stirring effect.

The fact that the rear of the carrier sheet is exposed can lead to various other advantages, in particular other apparatus may be located behind the sheet and/or access to the rear of the sheet is easy to obtain. In a particular alternative, a method and apparatus for realtime analysis or monitoring of reactions occurring in the sample sites during heating and/or stirring can be provided. This may be implemented by providing a optical probe in each sample site or well, typically this probe will be the tip of a optical fibre which is located in an aperture towards the base of the well. The fibre in each well will lead away from the rear (or underside) of the sheet to suitable transmitter, receiver and analysis equipment. The monitoring will typically make use of the fact that the fluorescing characteristics of the reagents change as the reaction progresses. Thus an exciting frequency of light will be fed from the transmitter along the fibres to each well. This exciting frequency will cause fluorescence in the reagents and the emitted light will travel back along the fibres to the receiver and analysis equipment where the fluorescence or changes in fluorescence will be analysed to give an indication of the state of the reaction.

What is claimed is:

1. A method of heating a specimen carrier of the kind comprising a plurality of specimen sites, in which said carrier is in the form of a metallic sheet and the method comprising applying a current to said sheet so as to provide resistance heating of said sheet so as to heat specimens carried by said carrier and in which a thickness of a metallic material of the sheet is thinner than an average thickness at a center of the sheet and thicker than said average thickness at an edge of the sheet in such a way as to promote even temperature distribution during heating.

2. A method according to claim 1 in which the step of applying a current to the sheet comprises the step of applying an alternating current to said sheet to provide said resistance heating, and wherein a magnet is loosely contained within at least one specimen site and is arranged to be agitated by the alternating current so as to provide a stirring action during the heating.

3. A method according to claim 1 wherein the thickness of the metallic material is thinner than the average thickness towards the center of the sheet and thicker than the average thickness along edges of the sheet running generally parallel to a direction in which current flows during operation.

4. A method according to claim 1 in which the sheet is formed by an electrodeposition process and the differences of thickness are achieved by controlling the electrodeposition process.

5. A method according to claim 1 in which the heating is applied as an alternating current providing resistive heating, and is controlled to provide repeated cycles of heating.

6. A method according to claim 1 in which said metallic sheet is of a metal having high electrical and high thermal conductivity.

7. A method according to claim 6 in which said metallic sheet is of silver.

8. A method according to claim 1 in which said sheet is a metallised plastic tray.

9. A method according to claim 1 in which said sheet is an electro-formed metal tray.

10. A method according to claim 1 in which said metallic sheet includes a plurality of wells to contain a plurality of specimens.

11. Apparatus for carrying out the method of claim 1 comprising a specimen carrier of the kind carrying a plurality of specimen sites, in which said carrier is in the form of a metallic electrically conductive sheet, a power supply, and a transformer having a primary winding connected to said power supply, and a secondary winding including to said conductive sheet and in which a thickness of a metallic material of the sheet is thinner than an average thickness at a center of the sheet and thicker than said average thickness at an edge of the sheet in such a way as to promote even temperature distribution during heating.

12. Apparatus according to claim 11 in which the power supply is arranged to apply an alternating current to said sheet to provide resistance heating, and wherein a magnet is loosely contained within at least one specimen site and is arranged to be agitated by the alternating current so as to provide a stirring action during the heating.

13. Apparatus according to claim 11 in which said secondary winding is a single turn winding.

14. Apparatus according to claims 11 comprising a temperature controller connected to regulate flow of heating current through said secondary winding at a rate which maintains a controlled heating temperature within said specimen carrier.

15. Apparatus according to claim 14 which comprises a fan cooling arrangement arranged to direct cooling air to a rear side of said specimen carrier and operatively connected to said temperature controller.

16. Apparatus according to claim 11 in which said metallic sheet is of a metal having high electrical and high thermal conductivity.

17. Apparatus according to claim 16 in which said metallic sheet is of silver.

18. Apparatus according to claim 11 in which said metallic sheet is a metallised plastic tray.

19. Apparatus according to claim 11 in which said metallic sheet is an electro-formed metal tray.

20. Apparatus according to claim 11 wherein the thickness of the metallic material is thinner than the average thickness towards the center of the sheet and thicker than the average thickness along edges of the sheet running generally parallel to a direction in which current flows during operation.

21. A method of heating a specimen carrier in the form of a metallic sheet and in which a matrix of sample wells is incorporated in the sheet, which method includes applying an alternating current to said sheet to provide heating of the samples in the wells, and wherein a magnet is loosely contained within at least one well and is arranged to be agitated by the alternating current so as to provide a stirring action during the heating.

22. A method according to claim 21 in which each well contains a magnet.

23. A method according to claim 21 in which the sheet is of a material of high thermal and high electrical conductivity.

24. A method according to claim 21 in which the sample wells are arranged to incorporate samples directly.

25. A method according to 21 in which the sample wells are arranged to carry one of sample pots and test tubes shaped to closely fit within the wells.

26. A method according to claim 21 in which the sample wells are conical in shape.

27. A method according to claim 26 in which the magnet is a bar magnet and the geometry of the conical section of the sample well constrains the bar to spin about an axis that is not coaxial with, or normal to, the axial dimension of the bar.

28. A method according to claim 21 in which the magnet is coated with a non-reactive material.

29. Apparatus for thermally cycling and stirring samples, the apparatus comprising, a specimen carrier in the form of a metallic sheet, in which sheet a matrix of sample wells is incorporated, a power supply arrangement for applying an alternating current to said sheet to provide heating of the samples in the wells, and a magnet loosely contained within at least one well which magnet is arranged to be agitated by the alternating heating current so as to provide a stirring action during heating.

30. Apparatus according to claim 29 in which each well contains a magnet.

31. Apparatus according to claim 29 in which the sheet is of a material of high thermal and high electrical conductivity.

32. Apparatus according to claim 29 in which the sample wells are arranged to incorporate samples directly.

33. Apparatus according to claim 29 in which the sample wells are arranged to carry one of sample pots and test tubes shaped to closely fit within the wells.

34. Apparatus according to claim 29 in which the sample wells are conical in shape.

35. Apparatus according to claim 34 in which the magnet is a bar magnet and the geometry of the conical section of the sample well constrains the bar to spin about an axis that is not coaxial with, or normal to, the axial dimension of the bar.

36. Apparatus according to claim 29 in which the magnet is coated with a non-reactive material.

37. A method of heating a specimen carrier of the kind comprising a plurality of specimen sites, in which said carrier is in the form of a metallic sheet and the method comprising applying a current to said sheet so as to provide resistance heating of said sheet so as to heat specimens carried by said carrier and in which the step of applying a current to the sheet comprises the step of applying an alternating current to said sheet to provide said resistance heating, and wherein a magnet is loosely contained within at least one specimen site and is arranged to be agitated by the alternating current so as to provide a stirring action during the heating.

38. Apparatus for carrying out the method of heating a specimen carrier of the kind comprising a plurality of specimen sites, in which said carrier is in the form of a metallic sheet and the method comprising applying a current to said sheet so as to provide resistance heating of said sheet so as to heat specimens carried by said carrier and further comprising a specimen carrier of the kind carrying a plurality of specimen sites, in which said carrier is in the form of a metallic electrically conductive sheet, a power supply, and a transformer having a primary winding connected to said power supply, and a secondary winding including to said conductive sheet and in which the power supply is arranged to apply an alternating current to said sheet to provide resistance heating, and wherein a magnet is loosely contained within at least one specimen site and is arranged to be agitated by the alternating current so as to provide a stirring action during the heating.

* * * * *